US010388192B2

(12) United States Patent
Milbrandt et al.

(10) Patent No.: US 10,388,192 B2
(45) Date of Patent: Aug. 20, 2019

(54) FLAT ELASTIC LABELING ARTICLE

(71) Applicant: Bedford Industries, Inc., Worthington, MN (US)

(72) Inventors: Jay A. Milbrandt, Worthington, MN (US); Axel Wass, Brewster, MN (US); Jeff Maltas, Sibley, IA (US); Colin O'Donnell, Worthington, MN (US)

(73) Assignee: Bedford Industries, Inc., Worthington, MN (US)

( * ) Notice: Subject to any disclaimer, the term of this patent is extended or adjusted under 35 U.S.C. 154(b) by 0 days.

(21) Appl. No.: 15/608,150

(22) Filed: May 30, 2017

(65) Prior Publication Data

US 2017/0372643 A1 Dec. 28, 2017

Related U.S. Application Data

(60) Provisional application No. 62/354,381, filed on Jun. 24, 2016.

(51) Int. Cl.
*G09F 3/00* (2006.01)
*G09F 3/04* (2006.01)
(Continued)

(52) U.S. Cl.
CPC ..... *G09F 3/04* (2013.01); *G09F 3/02* (2013.01); *G09F 3/14* (2013.01);
(Continued)

(58) Field of Classification Search
CPC ..... G09F 3/04; G09F 3/14; G09F 3/02; G09F 2003/0266; G09F 2003/027;
(Continued)

(56) References Cited

U.S. PATENT DOCUMENTS 92,895 A 7/1869 Southworth
109,263 A 11/1870 Southworth
(Continued)

FOREIGN PATENT DOCUMENTS

AU 2011224038 A1 10/2011
CN 204632247 U 9/2015
(Continued)

OTHER PUBLICATIONS

Partial International Search Report and Provisional Written Opinion of the International Searching Authority dated Aug. 31, 2017, for International Application No. PCT/US2017/035100.
(Continued)

*Primary Examiner* — Cassandra Davis
(74) *Attorney, Agent, or Firm* — Mai-Tram D. Lauer; Westman, Champlin & Koehler, P.A.

(57) ABSTRACT

A labeling article includes an elastic substrate and a tag. The elastic substrate has first and second opposed surfaces and a cut. The tag has third and fourth opposed major surfaces. An entirety of the third major surface overlies a portion of the first major surface. The third major surface is bonded to the first major surface. At least a portion of the tag is positioned adjacent the cut. In another aspect, a labeling article includes a first member and a second member. The first member is formed of an elastic material that includes a fastening opening therein and an interior portion that projects into the fastening opening. The second member is formed of an inelastic material that overlies at least the interior portion. The second and first members are bonded together. A composite web of labeling articles includes an elastic material web and first and second tag material strips.

20 Claims, 11 Drawing Sheets

(51) Int. Cl.
*G09F 3/02* (2006.01)
*G09F 3/14* (2006.01)

(52) U.S. Cl.
CPC ..... *G09F 2003/027* (2013.01); *G09F 2003/0227* (2013.01); *G09F 2003/0251* (2013.01); *G09F 2003/0266* (2013.01); *G09F 2003/0269* (2013.01); *G09F 2003/0272* (2013.01)

(58) Field of Classification Search
CPC ..... G09F 2003/0272; G09F 2003/0269; G09F 2003/0251; G09F 2003/0227
USPC ..... 220/751, 758, 756, 754, 752; 206/150, 206/459.5, 806; 248/127, 683; 215/399
See application file for complete search history.

(56) References Cited

U.S. PATENT DOCUMENTS 134,116 A 12/1872 West
161,145 A 3/1875 Moder
212,578 A 2/1879 Smith
224,958 A 2/1880 Rowland
263,600 A 8/1882 Searing
381,879 A 4/1888 Howard
D28,619 S 5/1898 McFadden
1,221,572 A 4/1917 Morton
1,353,531 A * 9/1920 Heard ..... G09F 3/04 40/310
1,397,079 A 11/1921 Cohen
1,830,410 A 11/1931 Schaaf
1,929,320 A 10/1933 Lulham
2,194,220 A 3/1940 Elder
2,194,898 A 3/1940 Hanford
2,362,523 A 11/1944 Armstrong
2,516,292 A 7/1950 Bennett
2,635,604 A 4/1953 Fredrickson
2,669,047 A 2/1954 Rieger
2,937,464 A 5/1960 Marshall
3,077,683 A 2/1963 Jones
3,164,250 A 1/1965 Paxton
3,299,442 A * 1/1967 White ..... A61G 7/0503 128/DIG. 24
3,545,795 A 12/1970 Hertel
3,589,764 A * 6/1971 Cunningham ..... B65D 25/2876 294/31.2
3,594,891 A * 7/1971 Cunningham ..... B44D 3/14 215/397
3,602,957 A 9/1971 Chang
3,621,809 A 11/1971 Paxton
3,635,367 A 1/1972 Morita
3,662,480 A 5/1972 Gilson
3,680,905 A * 8/1972 Klygis ..... B65D 25/2876 215/390
3,744,658 A 7/1973 Fujio
3,749,622 A 7/1973 Sato
3,777,378 A 12/1973 Sant' Anselmo
3,783,083 A 1/1974 Jenkins
3,807,679 A 4/1974 Burke
3,896,524 A 7/1975 Parker
3,930,506 A 1/1976 Overend
3,933,560 A 1/1976 Muttera
3,955,656 A 5/1976 Kashinski
4,119,449 A 10/1978 Gould
D251,121 S 2/1979 Smith
4,296,861 A 10/1981 Barrash
4,323,608 A 4/1982 Denny
4,341,303 A 7/1982 Britt
4,390,095 A 6/1983 Cunningham
4,407,082 A 10/1983 Stehouwer
4,412,624 A 11/1983 Tanaka
4,413,741 A 11/1983 Curchack
D272,316 S * 1/1984 Braun ..... D9/434
4,433,498 A 2/1984 Bienz
4,460,143 A 7/1984 Ohama
4,519,178 A 5/1985 Crabb
4,529,229 A 7/1985 Glibbery
4,582,215 A * 4/1986 Barrash ..... B65D 23/108 206/150
4,712,671 A 12/1987 Salacuse
4,749,426 A 6/1988 Wyss
4,779,731 A * 10/1988 Fujio ..... B65D 71/08 206/432
5,018,286 A 5/1991 Zahner
5,087,306 A 2/1992 Cheung
5,131,614 A 7/1992 Garcia
5,135,125 A * 8/1992 Andel ..... A61M 5/1417 215/12.1
5,207,746 A 5/1993 Jones
5,209,346 A * 5/1993 Pratt ..... B65D 71/504 206/150
D338,195 S 8/1993 Sugerman
RE34,366 E 9/1993 Instance
5,248,164 A 9/1993 Lepretre
5,279,019 A 1/1994 Knickle
5,322,724 A 6/1994 Levens
5,348,781 A 9/1994 Koblella
5,367,752 A 11/1994 Petty
5,388,739 A 2/1995 Gargan
5,467,897 A 11/1995 Williams
5,490,658 A * 2/1996 Coward ..... A61M 5/1417 215/399
5,531,696 A 7/1996 Menes
5,617,656 A 4/1997 Ludlow
D380,156 S * 6/1997 Zelenski ..... D9/434
D385,581 S 10/1997 Linz
D386,211 S 11/1997 Taparauskas
5,683,194 A 11/1997 Emmel
5,697,177 A 12/1997 Ludlow
5,700,537 A 12/1997 Instance
5,713,467 A 2/1998 Kao
5,733,652 A 3/1998 Stowman
5,778,583 A 7/1998 Larsen
5,782,495 A * 7/1998 Grosskopf ..... B32B 7/04 283/81
5,823,503 A * 10/1998 Wasserman ..... A61M 5/1417 248/683
5,866,219 A 2/1999 McClure
6,024,225 A 2/2000 Van der Donk
6,058,639 A 5/2000 Tinklenberg
6,076,669 A 6/2000 Ling
6,116,653 A 9/2000 Oberholzer
6,146,731 A 11/2000 Tanoto
6,270,834 B1 8/2001 Burrows
6,271,631 B1 8/2001 Burrows
6,279,255 B1 8/2001 Larsen
6,355,403 B1 3/2002 Bourdelais
6,378,700 B1 4/2002 Tong
6,381,890 B1 5/2002 Sjostedt
6,413,122 B2 7/2002 Fujioka
6,449,886 B1 9/2002 Gray
6,662,948 B1 * 12/2003 Velliquette ..... B65D 73/0021 206/462
6,701,532 B1 3/2004 Glassberg
6,766,917 B1 7/2004 Blewitt
D494,066 S 8/2004 Liu
6,810,811 B2 11/2004 Grounds
D501,892 S 2/2005 Perry
6,991,261 B2 1/2006 Dronzek
7,086,545 B2 8/2006 Mannion
D532,049 S 11/2006 Ludlow
7,281,345 B2 10/2007 Ludlow
7,922,022 B2 4/2011 Ciarrocchi
8,047,387 B2 11/2011 Chalekian
8,635,795 B2 1/2014 Ludlow
9,355,577 B1 5/2016 Coleman
2003/0096076 A1 5/2003 Allison
2003/0150919 A1 8/2003 Blank
2005/0138854 A1 6/2005 Simmons
2005/0166439 A1 8/2005 Ludlow
2005/0173073 A1 8/2005 Chernoff
2005/0255277 A1 11/2005 Syron

(56) References Cited

U.S. PATENT DOCUMENTS

| | | | |
|---|---|---|---|
| 2006/0086028 | A1 | 4/2006 | Vaughan |
| 2006/0147668 | A1 | 7/2006 | Hirose |
| 2006/0272185 | A1 | 12/2006 | Malama |
| 2007/0020423 | A1 | 1/2007 | Chamandy |
| 2008/0301853 | A1 | 12/2008 | Cummiskey |
| 2010/0006587 | A1 | 1/2010 | Newmark |
| 2010/0072794 | A1 | 3/2010 | Karovic |

FOREIGN PATENT DOCUMENTS

| | | | |
|---|---|---|---|
| EP | 1136971 | A2 | 9/2001 |
| FR | 2634574 | A1 | 1/1990 |
| GB | 451036 | A | 7/1936 |
| GB | 2255985 | A | 11/1992 |
| GB | 2382810 | A | 6/2003 |
| GB | 2405854 | A | 3/2005 |
| NI | 1016806 | C1 | 6/2002 |
| WO | 9824086 | A1 | 6/1998 |
| WO | 2007084119 | | 7/2007 |
| WO | 2014036246 | | 3/2014 |

OTHER PUBLICATIONS

International Search Report and Written Opinion of the International Searching Authority dated Oct. 24, 2017, for International Application No. PCT/US2017/035100.

* cited by examiner

FLAT ELASTIC LABELING ARTICLE

CROSS-REFERENCE TO RELATED APPLICATION

This application claims the benefit of priority from U.S. Provisional Patent Application No. 62/354,381, filed Jun. 24, 2016, for a "Flat Elastic Labeling Article," which is fully incorporated hereby in reference.

BACKGROUND

The prior art is replete with merchandise labeling using bands about merchandise. Sometimes the heretofore known bands have elastic sections united to non-elastic sections, and sometimes they are endless elastic bands commonly called rubber bands.

For example, U.S. Pat. No. 2,516,292 (Bennett) of Jul. 25, 1950 teaches a preformed labeling article of elastic and non-elastic sections for holding bananas constantly under tension as they shrink. The ends of the elastic and non-elastic sections of the band are overlapped and adhesively or otherwise bonded together. U.S. Pat. No. 5,733,652 (Stowman et al.) of Mar. 31, 1998 discusses banding of merchandise by a technique involving in situ bonding of the ends of a strip of elastic material with or without an interposed separate strip of material that is not necessarily elastic. In situ bonding, however, involves carrying bonding equipment to the site where banding of merchandise is to be done (e.g., for bonds formed by heat sealing) or involves removing and disposing of a release liner at the site of banding (e.g., for bonds formed by using liner-protected contact or pressure-sensitive adhesive layers). Neither approach is ideal for field application of labels. Also, when either a preformed band of bonded sections or an in situ formed band of bonded sections is stretched about merchandise, it exerts a compressive force on the merchandise. Relatively strong bonds are needed to prevent bond separation under such circumstances, since the bonds are in the line of stretching and are subjected to the tension of stretching during use. A still further problem is the questionable reliability of machine-readable codes on stretched bands encircling merchandise, such as UPC bar codes, for example.

Where endless bands of rubber (commonly called rubber bands) are used, as in teachings of U.S. Pat. No. 5,617,656 (Ludlow et al.); U.S. Pat. No. 5,697,177 (Ludlow et al.); and U.S. Pat. No. 6,058,639 (Tinklenberg), a second step arises for attaching a tag. The two-step approach is not the most efficient, although it has been one of the more popular approaches in the past because the tag is distinct from the rubber band and can carry reliable UPC bar coding that is easy to handle at checkout scanning.

A known merchandise marking article capable of single-step application to achieve simultaneous banding and scan-reliable bar-coding of merchandise is described in U.S. Pat. No. 5,778,583 (Larsen) of Jul. 14, 1998, where the tag is attached to the rubber band by encircling a section of the tag about the rubber band prior to the time the rubber band is fastened in banding condition about merchandise. However, economy is not a hallmark for the manufacture of this prior art article.

In short, a one-step process using an economical unitary product for reliable and simultaneous tagging and banding of merchandise, including for tagging and banding clumps of agricultural produce, is much desired.

SUMMARY

In one aspect, a labeling article includes an elastic substrate and a tag. The elastic substrate is configured as a first sheet having first and second opposed major surfaces and including a cut disposed through the elastic substrate. The tag is configured as a second sheet having third and fourth opposed major surfaces. An entirety of the third major surface of the tag overlies a portion of the first major surface of the elastic substrate. The third major surface of the tag is bonded to the first major surface of the elastic substrate. At least a portion of the tag is positioned adjacent the cut.

In another aspect, a labeling article includes a first member and a second member. The first member is formed of a sheet-like elastic material that includes a fastening opening therein and an interior portion that projects into the fastening opening. The second is member formed of a sheet-like inelastic material that overlies at least the interior portion of the first member. The second member and first member are bonded together along coextensive portions.

In yet another aspect, a composite web of a plurality of labeling articles includes an elastic material web, a first tag material strip, and a second tag material strip. The elastic material web has a width dimension between first and second opposed edges, has first and second opposed major surfaces, and has a length dimension in a direction substantially orthogonal to the width dimension. The first tag material strip has third and fourth opposed major surfaces. The first tag material strip overlies a first portion of the first major surface of the elastic material web between the first and second opposed edges and does not extend beyond either of the first or second opposed edges. The third major surface of the first tag material strip is bonded to the first major surface of the elastic material web. The second tag material strip has fifth and sixth opposed major surfaces. The second tag material strip overlies a second portion of the first major surface of the elastic material web between the first and second opposed edges and does not extend beyond either of the first or second opposed edges. The fifth major surface of the second tag material strip is bonded to the first major surface of the elastic material web.

This disclosure, in its various combinations, either in apparatus or method form, may also be characterized by the following listing of items:

1. A labeling article including:
   - an elastic substrate configured as a first sheet having first and second opposed major surfaces and including a cut disposed through the elastic substrate; and
   - a tag configured as a second sheet having third and fourth opposed major surfaces, wherein:
     - an entirety of the third major surface of the tag overlies a portion of the first major surface of the elastic substrate;
     - the third major surface of the tag is bonded to the first major surface of the elastic substrate; and
     - at least a portion of the tag is positioned adjacent the cut.
2. The labeling article of item 1 wherein the cut forms a perforation.
3. The labeling article of any of items 1-2 wherein the cut forms a portion of an aperture through the elastic substrate.
4. The labeling article of any of items 1-3 wherein the tag includes two sections that are separable from each other.
5. The labeling article of item 4 wherein the two sections are substantially equal in size.
6. The labeling article of any of items 4-5 further including an aperture disposed in one of the two sections.
7. The labeling article of any of items 1-6 wherein the tag is formed of a substantially inextensible material.
8. The labeling article of any of items 1-7 wherein the elastic substrate is configured to substantially include a loop with an interior portion passing through a center of the loop, wherein the tag is positioned on the interior portion.

9. The labeling article of any of items 1-8 further including indicia disposed on the fourth major surface of the tag.

10. A labeling article including:

a first member formed of a sheet-like elastic material that includes a fastening opening therein and an interior portion that projects into the fastening opening; and a second member formed of a sheet-like inelastic material that overlies at least the interior portion of the first member, wherein the second member and first member are bonded together along coextensive portions.

11. A composite web of a plurality of labeling articles including:

an elastic material web having a width dimension between first and second opposed edges, having first and second opposed major surfaces, and having a length dimension in a direction substantially orthogonal to the width dimension;

a first tag material strip having third and fourth opposed major surfaces, wherein:

the first tag material strip overlies a first portion of the first major surface of the elastic material web between the first and second opposed edges and does not extend beyond either of the first or second opposed edges; and the third major surface of the first tag material strip is bonded to the first major surface of the elastic material web; and a second tag material strip having fifth and sixth opposed major surfaces, wherein:

the second tag material strip overlies a second portion of the first major surface of the elastic material web between the first and second opposed edges and does not extend beyond either of the first or second opposed edges; and the fifth major surface of the second tag material strip is bonded to the first major surface of the elastic material web.

12. The composite web of item 11 further including a first cut through the elastic material web that at least partially separates a first linear series of a first set of the plurality of labeling articles including the first tag material strip and a second linear series of a second set of the plurality of labeling articles including the second tag material strip.

13. The composite web of item 12 further including a first aperture through the elastic material web, the first aperture located on one of the plurality of labeling articles.

14. The composite web of any of items 12-13 further including a second cut through the first tag material strip and an underlying portion of the elastic material web that at least partially separates adjacent labeling articles of the first linear series.

15. The composite web of item 14 further including a third cut through the first tag material strip and an underlying portion of the elastic material web that at least partially separates first and second sections of the tag material strip of an individual labeling article of the first linear series.

16. The composite web of any of items 14-15 further including a third cut through the second tag material strip and an underlying portion of the elastic material web that at least partially separates adjacent labeling articles of the second linear series, wherein the third cut is offset along the length dimension from the second cut.

17. The composite web of item 16 further including a fourth cut through the first tag material strip and an underlying portion of the elastic material web that at least partially separates first and second sections of the tag material strip of an individual labeling article of the first linear series, wherein the fourth cut is aligned along the length dimension with the third cut.

18. The composite web of any of items 12-17 wherein the first set of the plurality of labeling articles are offset along the length dimension from the second set of the plurality of labeling articles.

19. The composite web of any of items 11-18 wherein each of the first tag material strip and the second tag material strip includes a repeating pattern of printed indicia.

20. The composite web of item 19 wherein the printed indicia of the first tag material strip are aligned along the length dimension with the printed indicia of the second tag material strip.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. Moreover, analogous or related structures may be indexed in increments of one hundred. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise. Additionally, while terms such as diameter and circumference may be used in this description, it is to be understood that the articles described herein need not be circular, but may instead have other closed shapes, whether symmetric or asymmetric.

DETAILED DESCRIPTION

Figure 1:
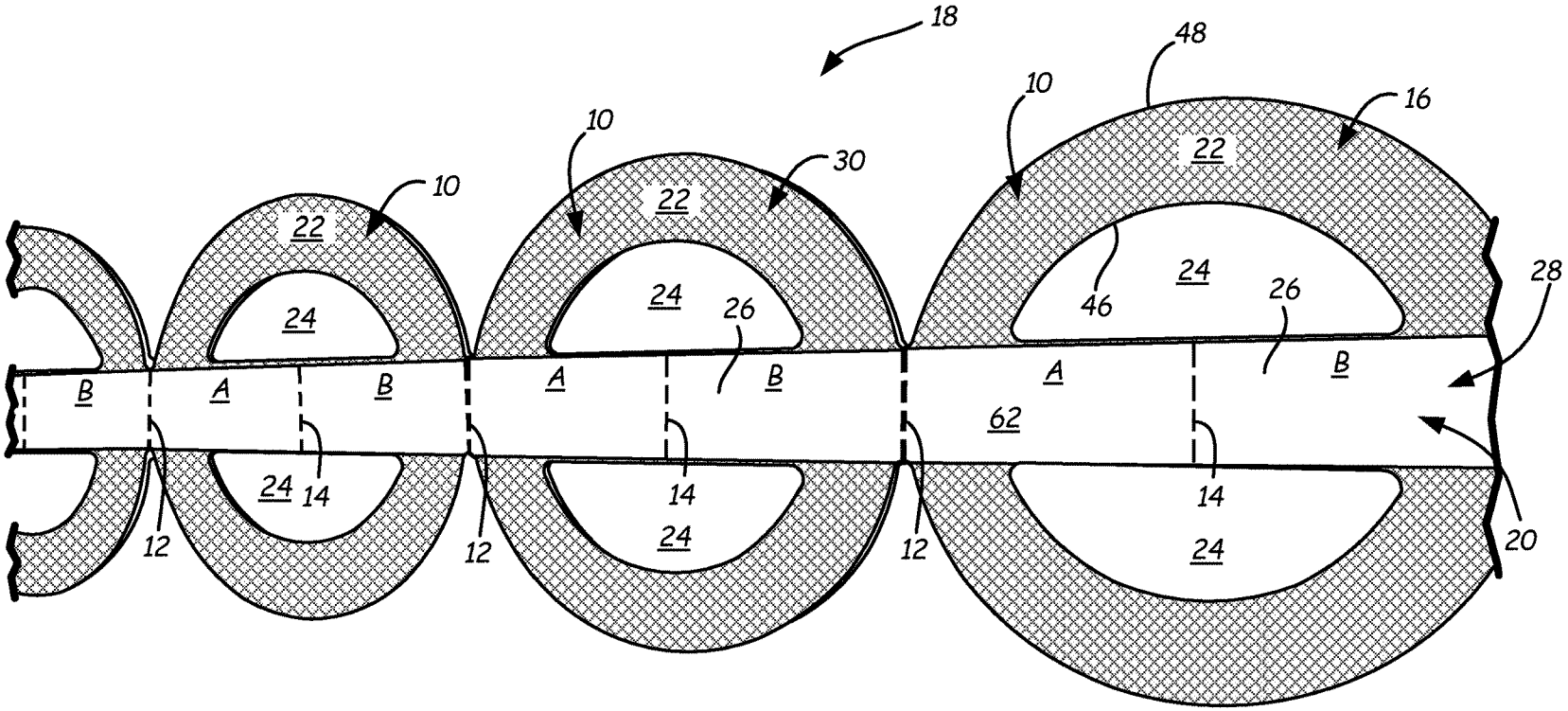
FIG. 1 is a front view of a portion of a linear series of rupturably connected flat elastic labeling articles in a first exemplary embodiment.
Figure 2:
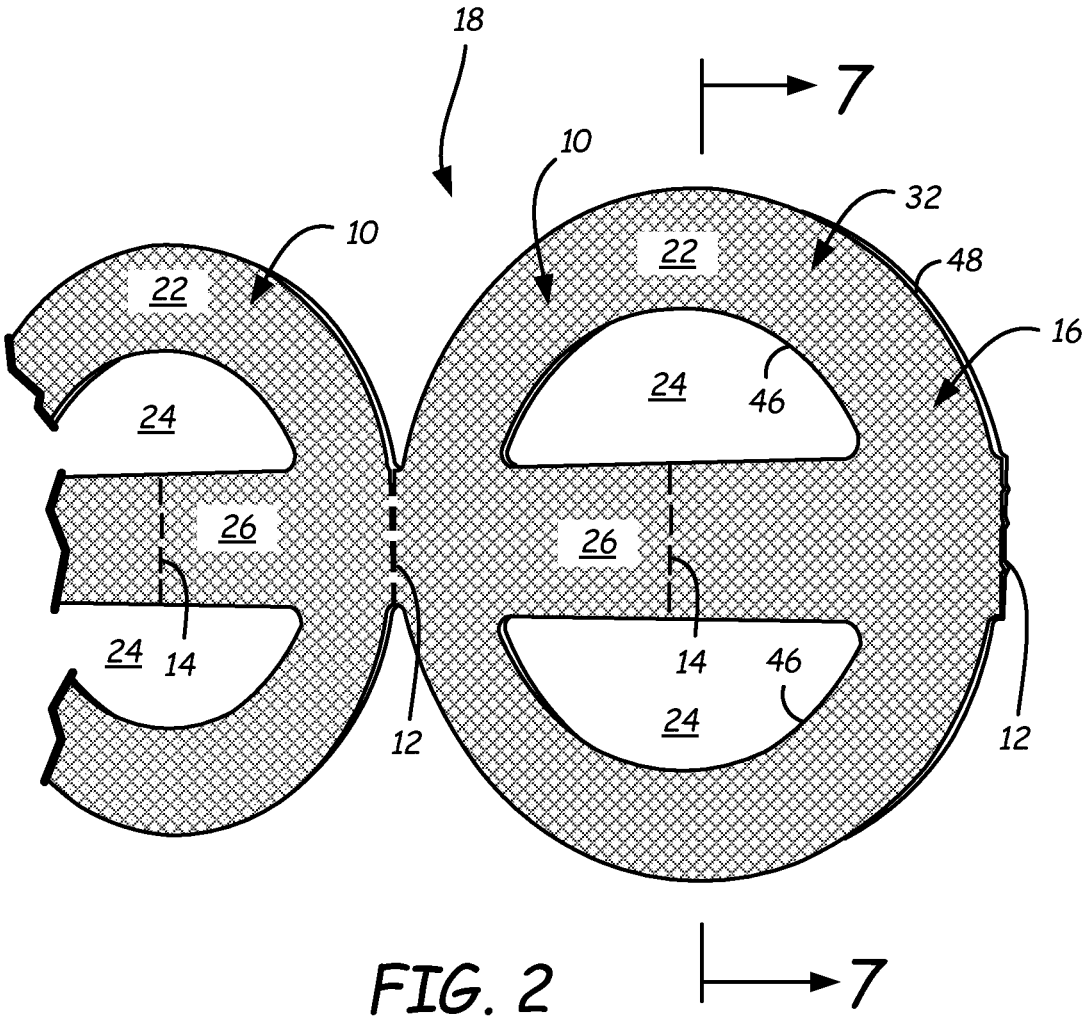
FIG. 2 is a back view of an end portion of the linear series of FIG. 1.

FIGS. 1 and 2 show opposite sides or major surfaces 30 and 32, respectively, of a linear series 18 of a connected plurality of separable flat elastic labeling articles 10. Each of the flat elastic labeling articles 10 is formed with elastic substrate 16 cut as a substantially circular elastomer loop 22 surrounding an aperture or cut-out area 24. An interior portion 26 located within loop 22 is configured in the illustrated embodiment as bisecting cut-out area 24. As shown in FIG. 1, on one side 30 of the flat elastic labeling article 10, a printable tag 28 is bonded to the elastic substrate 16 along interior portion 26 and adjacent portions of loop 22. The flat elastic labeling article 10 is sheet-like throughout. Tag 28 and elastic substrate 15 are conjoined along a unifying flat bond zone 20, labeled in FIG. 7.

Figure 3:
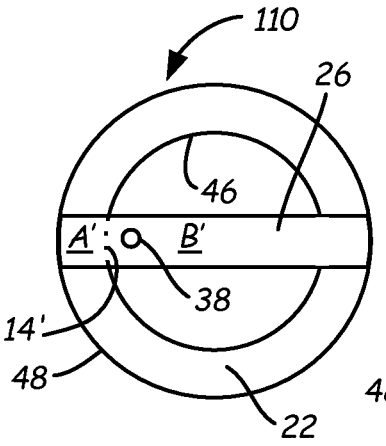
FIG. 3 is front view of a second exemplary embodiment of a flat elastic labeling article.
Figure 5:
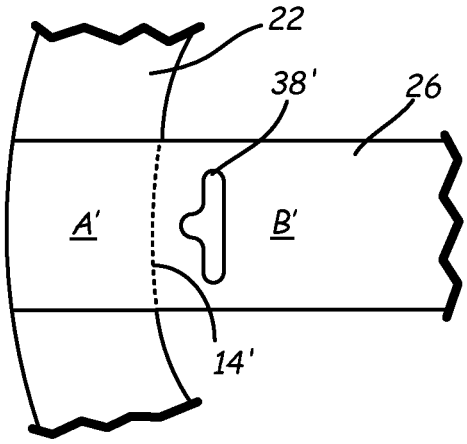
FIG. 5 is front view of a portion of the flat elastic labeling article of FIG. 3, showing an alternative aperture configuration.
Figure 6:
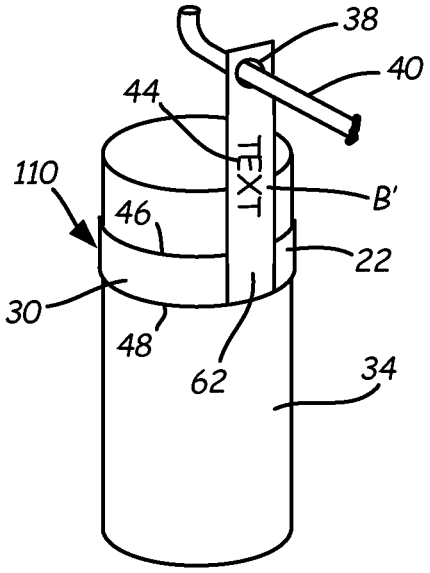
FIG. 6 is a rear perspective view of a product secured in the loop of the flat elastic labeling article of FIG. 3, and suspended from a retention mechanism.
Figure 8:
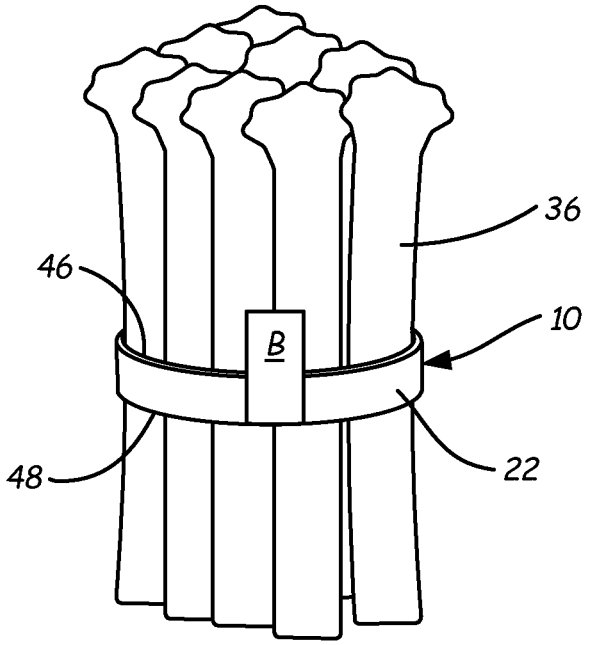
FIG. 8 is a front view of a bundle of products secured in the loop of the flat elastic labeling article of FIG. 3.
Figure 9:
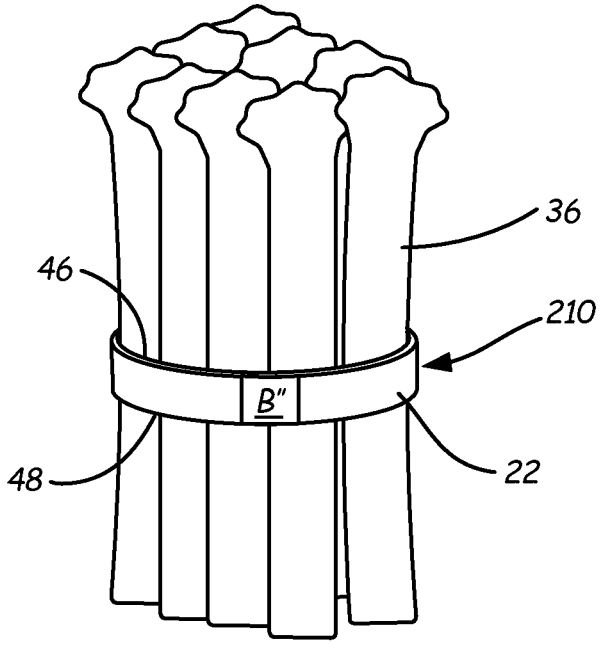
FIG. 9 is a front view of a bundle of products secured in the loop of the flat elastic labeling article of FIG. 4A.

Individual flat elastic labeling articles 10 can be separated from each other at perforations 12. An additional line of perforations 14 is provided within an individual flat elastic labeling article 10. When the perforations at 12 and 14 are broken, the expandable loop 22 of an individual labeling article 10 can be placed around a product 34 or bundle of products 36, as shown in FIGS. 6, 8 and 9. Two tag sections A and B, configured to bear indicia 44 such as printed information, will then be visible on opposite sides of the banded product 34, 36. As shown in FIGS. 2-4B, the placement of one or more sets of perforations 14, 14', 14" on each flat elastic labeling article 10, 110, 210 can result in tag portions A, A', A" and B, B', B" having different sizes and configurations. Moreover, as shown in FIGS. 3, 5 and 6, one or more of the tag sections A, B can include an aperture 38, by which the tag portion (B' as illustrated), and thus a product 34 held by expandable loop 22, can be suspended from a retaining hook or other retention mechanism 40. In an exemplary embodiment, tag 28 having tag sections A, B is formed of an inextensible (non-stretchable) material, making it suitable for bearing reliable machine-readable indicia such as UPC bar codes. While particular configurations of labeling article 10, 110, 210, 310, 410, 510, 610 are illustrated and described, it is contemplated that other configurations are also possible. Descriptions of one of the embodiments of labeling article 10, 110, 210, 310, 410, 510, 610 apply to all of the embodiments unless otherwise noted. In some drawings, elastic substrate 16 is illustrated with a decorative surface pattern; in other drawings, the pattern is not shown for clarity of illustration.

Figure 7:
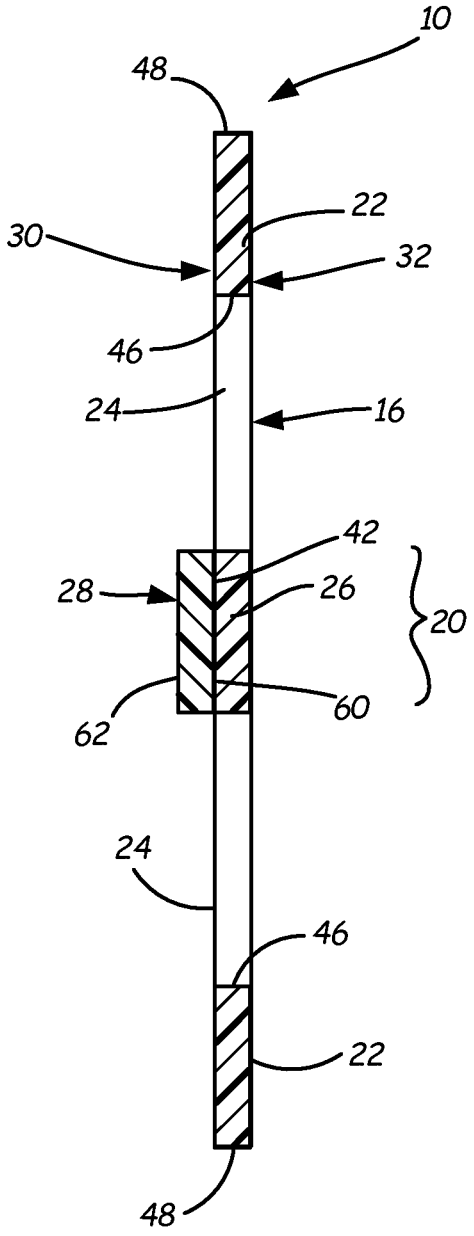
FIG. 7 is a cross-sectional view of the flat elastic labeling article of FIGS. 1-2, taken along line 7-7 of FIG. 2.

Flat elastic labeling article 10 has a tag 28 flatly conjoined along a unifying flat bond zone 20 with a flexible elastic substrate 16. Elastic substrate 16 is configured with expandable loop 22 that has a flat configuration that is wider than it is thick (as illustrated at FIG. 7, which is not drawn to scale). A labeling article 10, and a linear series 18 of multiple rupturably connected labeling articles 10, are sheet-like in the sense that the elastic substrate 16 is formed of a web of elastomeric material that is flat in character, and the tag 28 is formed of a strip of tag material that is flat in character, although they may be drapeable and floppy and thus not always displayed in flat form. As shown in FIGS. 7-11, the strip 128 of tag material for tag 28 and web 116 of elastic material for elastic substrate 16 are flatly conjoined so that the sheet character of each is aligned with the sheet character of the other, giving a total unitary sheet-like character to a labeling article 10, a linear series 18 of multiple connected labeling articles 10, and a web 50 of multiple linear series 18*a*, 18*b* (see FIG. 11).

As shown in FIG. 7, bond zone 20 is formed where tag 28 overlies and overlaps elastic substrate 16. As shown in FIG. 1, in an exemplary embodiment, tag 28 overlies elastic substrate 16 along the entirety of interior portion 26 and also on portions of expandable loop 22 that connect the interior portions 26 of adjacent labeling articles 10. In an exemplary embodiment, bond zone 20 is located at the entire interface 42 between tag 28 and elastic substrate 16. However, in other embodiments, tag 28 and elastic substrate 16 may be bonded together only at portions of interface 42. While labeling article 10 is depicted as having a circular outer configuration in illustrated embodiments, it is contemplated that other suitable closed shapes may be used, such as ovals, ellipses, and polygons, for example, whether symmetrical or asymmetrical. Cut-out area 24 likewise can be shaped other than circular or substantially semi-circular (see, for example cut-out area 24' of FIG. 14).

The thickness of tag 28 is great enough to give some body effect but ideally will not be greater than necessary for carrying appropriate indicia to describe or identify a product or convey other information or images. Tag 28 in an exemplary embodiment is in the form of a continuous strip of sheet material, including sheet material with holes or perforations therethrough (for example, apertures 38 and perforations 12, 14). A suitable sheet material for tag 28 is preferably relatively thin, generally not over about 15 or 20 mils (i.e., 0.015 or 0.020 inch) in thickness (although thicknesses up to 30 or 40 mils can be used). The tag material should be flexible and pliable but is most preferably inextensible (e.g., not stretchable and not elastic) for most applications. For purposes of this disclosure, an elastic material is one that has an initial dimension in a relaxed state; the dimension increases under tension, such as by stretching; moreover, upon release of the tension force, the dimension returns to, or nearly to, the initial unstretched dimension. In an exemplary embodiment, the tag material is sufficiently non-elastic and non-stretchy under hand-applied forces that a UPC scannable code is not rendered unreliable for scanning. Thus, the sheet material for tag 28 should have sufficient dimensional stability to carry a reliably scannable (i.e., non-distorted) print of a UPC code as well as other human-readable or machine-readable markings. Indicia 44 may include information readable by a human and/or a machine and can be provided by means including printing, embossing, and other known means.

In an exemplary embodiment, the sheet material for tag 28 is sufficiently water resistant to not disintegrate and not significantly pucker, wrinkle, or otherwise disfigure or deform when placed in water. Moreover, in an exemplary embodiment, inks or other printing media used on the sheet material for tag 28 are sufficiently water resistant to avoid disintegration or destruction when repeatedly subjected to water and washing operations (as is common for produce displays in supermarkets). The sheet material for tag 28 also should be somewhat tough in the sense of being sufficiently tear resistant to deter damage to it during banding, storage, transport and display, or by staff or customer handling.

Suitable materials for forming the tag 28 include paper, polystyrenic thermoplastics, polyolefinic thermoplastics, polyesters, and others. Exemplary suitable thermoplastic materials include polymers of styrene, ethylene, propylene, as well as a variety of other monomers and mixtures of monomers (e.g., to make co-polymers and ter-polymers, etc.). Sheet thickness for polyester plastics and some others can be quite thin, even down to the 3 or 4 mil range, and still exhibit the toughness and the practical non-elasticity desired.

The polymers may be formulated so that printing inks are readily accepted on the surface of the sheet material. Polymers can also be treated with special surface treatments to enhance acceptance of printing inks. The exact structure and composition of suitable tag sheet materials for tag 28 can vary widely. Any of a variety of commercially available inks compatible with or accepted on a tag strip 128 and retained thereon, and in any desired color, may be used to print indicia 44 such as written information on tag 28. In a case where it is desirable to use a water-soluble ink, a thin film of water-insoluble plastic may be applied over the ink to enhance water resistance of the printed markings.

To increase impact resistance of tag 28, a styrene-butadiene-styrene impact modifier can be useful in amounts up to about 40 percent of the weight of a polystyrene material. Tags 28 of such material are highly stable against stretching of the type that will damage scannability for bar codes. They have desired flexibility balanced by a slight stiffness that contributes to ease of handing during manufacture and use, including scanning of a machine-readable code at a check-out counter. Such tags 28 also can be reliably printed, especially when first subjected to a surface treatment such as, for example, a corona treatment such as available from Pillar Technologies of Hartland, Wis., a division of Illinois Tool Works. The treatment enhances wettability and adhesion characteristics of inks and adhesives on plastic substrates.

FIG. 3 is front view of a second exemplary embodiment of a flat elastic labeling article 110. In this embodiment, perforations 14' are not centered between perforations 12, as in the flat elastic labeling article 10 of FIGS. 1 and 2. Rather, perforations 14' are offset from a center of interior portion 26 so that tag section A' is smaller than tag section B'. In the illustrated embodiment, perforations 14' are positioned to connect segments of inner circumference 46 so that tag section A' does not extend from expandable loop 22. In contrast, tag section B' overlies the entirety of interior portion 26 and a portion of expandable loop 22. In an exemplary embodiment, tag section B' is provided with aperture 38, so that tag section B' can serve as a hang tab, as shown in FIG. 6.

FIG. 6 is a rear perspective view of a product 34 secured in the expandable loop 22 of the flat elastic labeling article 110, and suspended from a retention mechanism 40 by aperture 38. This use of flat elastic labeling article 110 is especially suitable for lightweight products 34 that are sufficiently held by frictional and compressive forces between the product surface and the second side 32 of expandable loop 22 of article 110. Also shown in FIG. 6, tag section B' is provided with indicia 44 so that tag section B' serves as an informational tag as well as a hang tab. FIG. 5 is front view of a portion of the flat elastic labeling article 110, showing an alternative aperture 38' configuration.

Figure 4A:
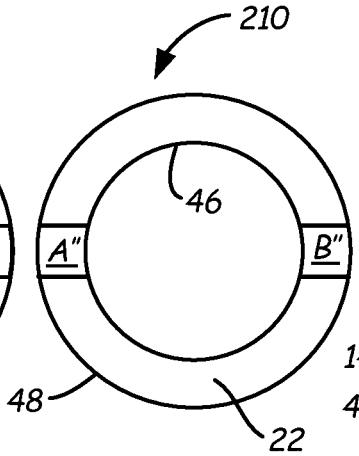
FIG. 4A is front view of a third exemplary embodiment of a flat elastic labeling article.
Figure 4B:
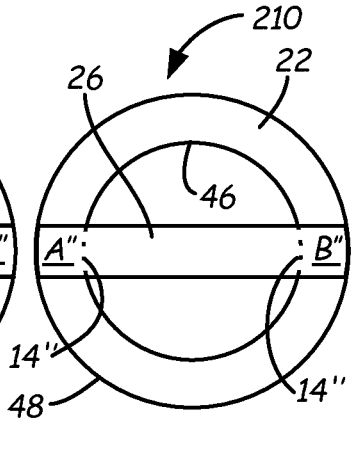
FIG. 4B is a front view of an intermediate product formed in the manufacture of the flat elastic labeling article of FIG. 4A.

FIG. 4A is front view of a third exemplary embodiment of a flat elastic labeling article 210. FIG. 4B is a front view of an intermediate product formed in the manufacture of the flat elastic labeling article 210. As shown in FIG. 4B, two sets of perforations 14" are provided to connect segments of inner circumference 46. In this case, the entire interior portion 26 is removed. Thus, both tag sections A" and B" do not extend from expandable loop 22. It is evident that many variations of sizes and shapes of tag sections are possible, depending on the shape and placements of cuts, perforations, tag materials, sizes and location of removed elements, and sizes and shapes of elastomer portions not forming loop 22 (such as elastomer portions $E_1$, $E_2$ and $E_3$ of FIG. 14, for example). Moreover, while perforations lines 12, 14 are generally illustrated as straight lines, it is contemplated that they may be differently shaped, include undulating curves, scalloped lines, and zig-zag lines, among others.

FIG. 8 is a front view of a bundle 36 of products secured in the loop 22 of the flat elastic labeling article 110 of FIGS. 1 and 2. FIG. 9 is a front view of a bundle 36 of products secured in the loop 22 of the flat elastic labeling article 210 of FIG. 4A. In each of FIGS. 6, 8 and 9, the tag section A', A and A" is on an opposite side of loop 22 and is not therefore visible in those drawings, its view being obscured by the connected product 34 or bundle 36 of products. Quick and easy application of flat elastic labeling article 10, 110, 210, 310, 410, 510, 610 to product(s) 34, 36 in a single step can be accomplished in a variety of ways. For factory operations, the flat elastic labeling article 10, 110, 210, 310, 410, 510, 610 may be applied automatically by a mechanical applicator machine. Hand application at a variety of off-factory sites can be easily accomplished. Because inner perimeter 46 is shorter than outer perimeter 48, the portion of expandable loop 22 near inner perimeter 46 stretches more than the portion of expandable loop 22 near outer perimeter 48 in many applications.

Figure 14:
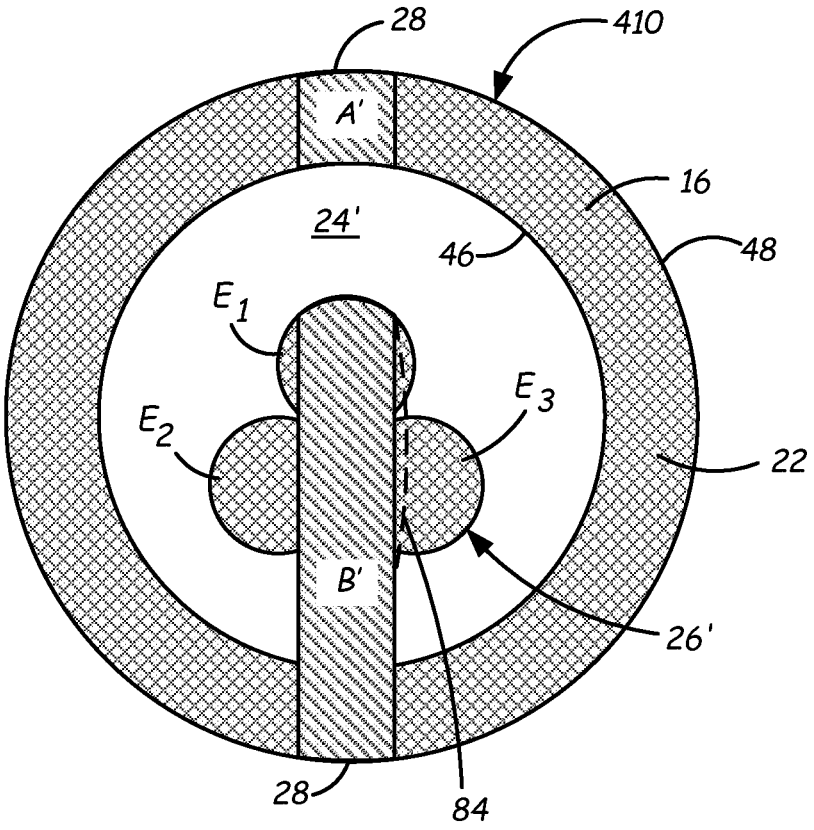
FIG. 14 is a front view of a fifth exemplary embodiment of a flat elastic labeling article.
Figure 15:
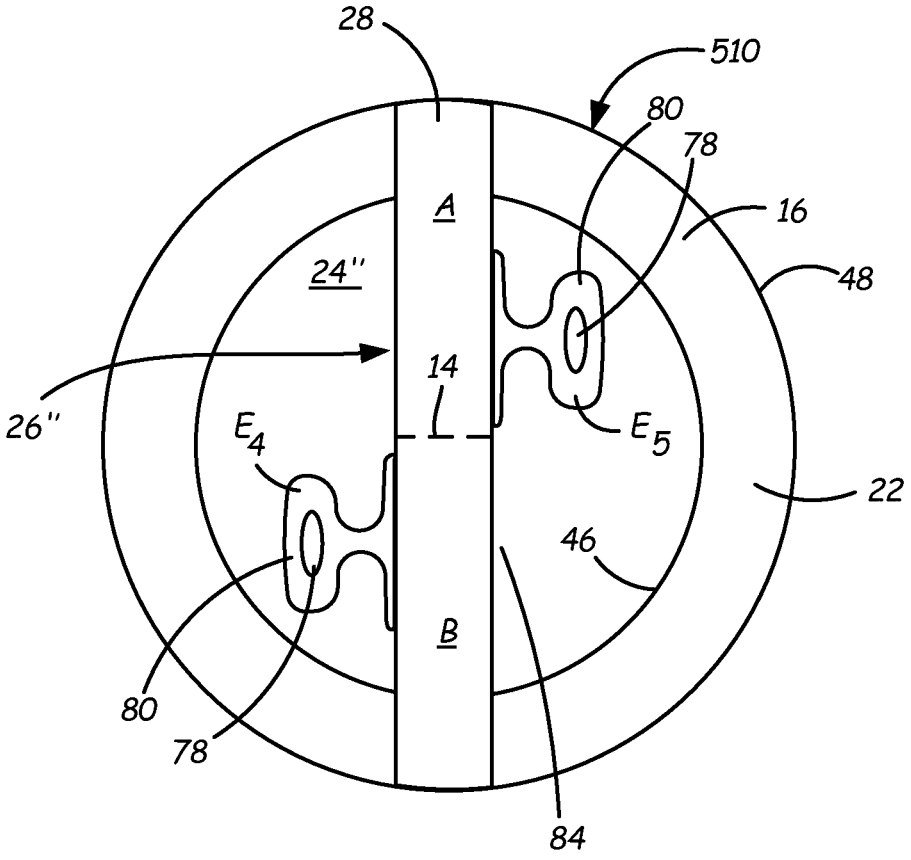
FIG. 15 is a front view of a sixth exemplary embodiment of a flat elastic labeling article.
Figure 18:
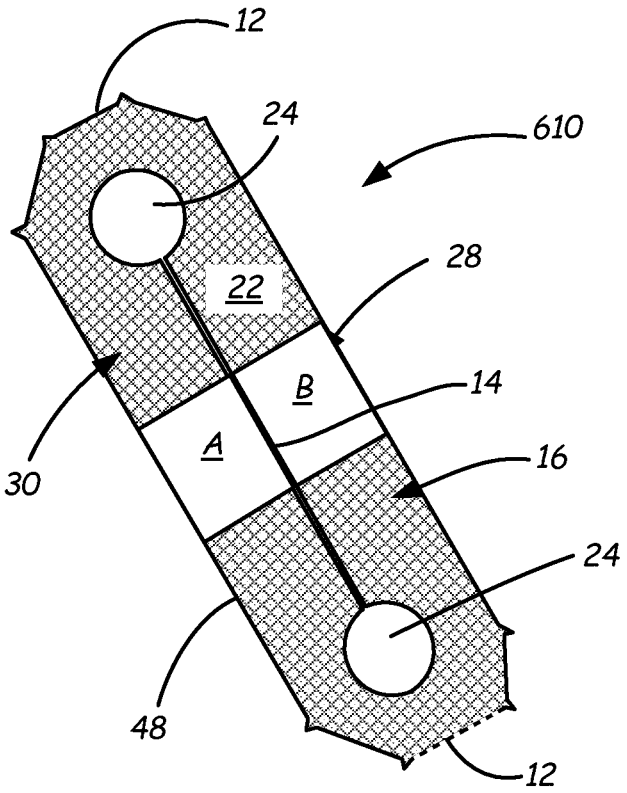
FIG. 18 is a front view of a seventh exemplary embodiment of a flat elastic labeling article.

While particular configurations and relative sizes for interior portion 26 and corresponding tag sections A, B are illustrated, it is to be understood that such configurations and sizes can vary depending on a particular purpose or desired visual effect. These considerations can also depend at least in part on the product 34, 36 with which the labeling article 10, 110, 210, 310, 410, 510, 610 is intended for use. Thus, an overall visual and functional presentation of a displayed and labeled product may affect the particular configurations of a flat elastic labeling article 10, 110, 210, 310, 410, 510, 610. In the illustrated embodiments, the tag sections A, B have generally rectangular configurations. However, it is contemplated that one or more tag sections can have any shape within outer perimeter 48. Indicia 44 may include informational or decorative matter to be printed, embossed, or otherwise provided on the tag 28, such as a scannable UPC code, PLU numbers, product description, illustration, trademarks or source markings, addresses, and phone numbers, and other matter. A visual presentation of labeling article 10, 110, 210, 310, 410, 510, 610 can also be provided by creative cutting to provide desired shapes and forms, such as shown in FIGS. 14, 15 and 18, for example. In another embodiment of a labeling article, interior portion 26 may substantially take up an entire area within inner perimeter 46, so that essentially no area is cut out and removed therebetween.

In an exemplary embodiment, elastic substrate 16 generally has a layer thickness that is greater than the thickness of the tag 28 by at least about 20 percent up to about four or five or six times the thickness of the tag 28 (as for example where tags 28 having a thickness of only about 6 to about 8 mils are employed). In an exemplary embodiment, a thickness of elastic substrate 16 is greater than about twice the thickness of tag 28, but usually will not exceed about 30 or 35 mils when the tag thickness lies in what is expected to be the popular range of about 5 to about 10 mils. It is conceivable, of course, to form labeling article 10, 110, 210, 310, 410, 510, 610 with a tag thickness and elastic layer thickness approximately equal (especially where one employs fusion bonding for the bond zone 20 between the tag material and the elastic material). It is also conceivable to use elastic layer thicknesses up to but not usually greater than 100 mils.

An individual labeling article 10, 110, 210, 310, 410, 510, 610 is removed from linear series 18 by separation at perforations 12. Upon breaking any internal perforations 14 of a labeling article 10, 110, 210, 310, 410, 510, 610, expandable loop 22 in an exemplary embodiment has sufficient elastic strength to permit stretching of loop 22 having an inner perimeter or circumference 46 to at least three times the size of the relaxed, unstretched inner circumference 46 without fracture of elastic substrate 16 other than at perforations 12, 14. The relaxed unstretched inner circumference 46 will vary depending on the size of the opening desired for the loop 22. The relaxed unstretched inner circumference 46 typically ranges from about 1.5 inches up to about 5 inches but is not limited to this typical range. In this disclosure, the term "circumference" is loosely used to refer to a perimeter of a closed shape and thus is applicable for describing an edge of an oval, elliptical or other closed polygon or shape (whether symmetrical or asymmetrical) that may not be circular.

A width of loop 22 between inner circumference 46 and outer circumference 48 is adequate to provide requisite strength for the loop 22 as it is placed about product 34, 36 (especially clumped merchandise such as onions or asparagus, etc.). Widths for loop 22 in exemplary embodiments fall within a range of at least 100 mils (generally at least about ⅛ inch or 125 mils) up to about ½ inch or about 500 mils. These widths are especially suitable for thicknesses of elastic substrate 16 between about 0.012 inch (12 mils) and 0.030 inch (30 mils).

In an exemplary embodiment, materials for forming the elastic substrate 16 are rubber-like in character. The material desirably recovers from a stretched condition relatively quickly; however, instantaneous retraction or recovery to an original relaxed condition and dimension after stretching is not always critical for functional elastic performance. Substantially instantaneous retraction to a loop inner circumference dimension 46 no greater than 5 percent above the original unstretched loop inner circumference 46 dimension suffices for a multitude of uses. A substantially instantaneous loop retraction is accomplished when, after having been momentarily stretched to a predetermined extent, it takes no more than 3 seconds for the loop to retract (i.e., recover) to an inner circumference size no more than 5 percent greater than the inner circumference of the original unstretched loop. A momentarily stretched condition is one in which the stretch is not held for more than 3 seconds, and the predetermined extent of the stretch is three times (or more) the inner circumference of the loop in unstretched relaxed condition. There may be occasions where retraction may take possibly up to about 10 seconds and still may constitute sufficiently quick retraction to be useful as elastic material for the purposes of this disclosure. Those skilled in the art of elastic performance features are capable of selecting materials such as elastomers possessing the elastic stretch and retraction characteristics desired for a particular use.

In selecting an elastic materials such rubber or elastomers for elastic substrate 16, substantially instantaneous retraction is most preferred for rapid bundling of products; slower retraction may allow some product to fall out of the bundle before retraction takes place. On the other hand, a modestly slower retraction may be quite adequate where labeling article 10, 110, 210, 310, 410, 510, 610 is to be stretched about a single product under conditions where speed of retraction (bounce back) is reliable but not a dominant consideration.

Particularly suitable elastomers are those that are thermoplastic in that they at least soften in response to heat, or even melt, to a flowable or moldable state. A multitude of thermoplastic elastomers are known and more are being created. A suitable family of thermoplastic elastomers includes styrenic block co-polymers. This family includes styrene-butadiene styrene and styrene-ethylene-butylene styrene. Another family of useful thermoplastic elastomers include olefinic elastomers, including those that are ethylene based as well as those that are polypropylene based. In some cases, monomer blocks of different tacticity—atactic and isotactic—are created by using metallocene catalysis polymerization. Yet another family of thermoplastic elastomers include polyvinyl chloride-based elastomers. Still other families of thermoplastic elastomers can be based on urethanes, nylon, and silicon, for example.

Selection of an elastomer material may take into account factors such as cost and bonding compatibility with a material of tag 28. Generally, similar materials tend to bond together (as by polymer bonding) better than dissimilar materials; and materials of like polarity usually bond better than materials of unlike polarity. Thus, tag material selection can be made from polymers in the same family as the elastomer, such as those including at least some monomers related to, or the same as those present in, the elastomer chosen for the elastic substrate 16. Surface treatments such as corona treatments also help to improve bonding. Still further, compatibilizers that adjust the polarity of material can be used to improve bonding. Additional information is described in U.S. Pat. No. 8,635,795 to Ludlow et al., which is hereby incorporated by reference. A common practice in handling polymeric materials for tag 28 and elastic substrate 16 is to add compatible (i.e., readily blendable) ingredients to achieve desired properties such as coloration, opacification, resistance to degradation on exposure to environmental conditions, improved impact properties and adhesion properties, for example.

In an exemplary embodiment, elastic substrate 16 is substantially uniform in composition throughout. On the other hand, the tag 28 may be a laminate of different layers, including a possible protective coating over a printed layer, especially a printed layer that is believed to need further protection against smudging or destruction. In an exemplary embodiment, bond zone 20 will extend over an entire interface 42 between elastic substrate 16 and tag 28. In other embodiments, elastic substrate 16 and tag 28 may be bonded together at only a portion of their overlap or interface 42.

Figure 16:
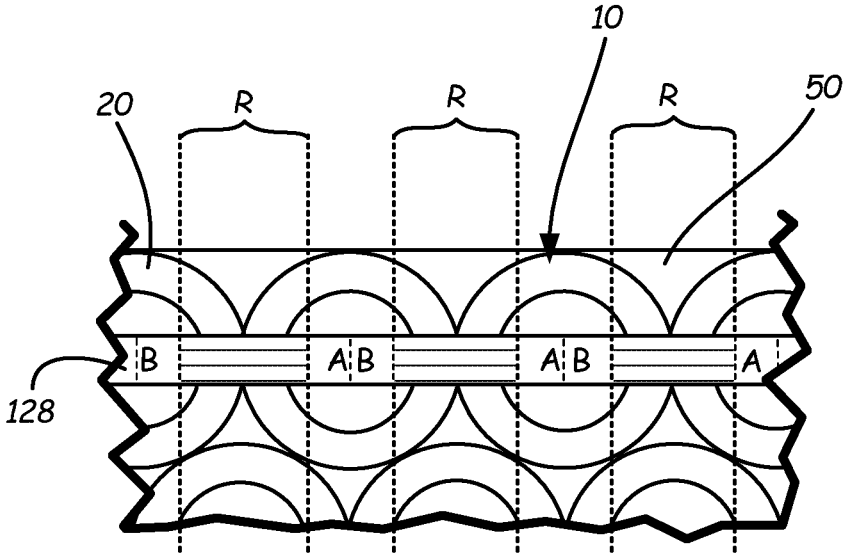
FIG. 16 is a top view of a portion of the composite elastomer web including zones of release agent R.
Figure 17:
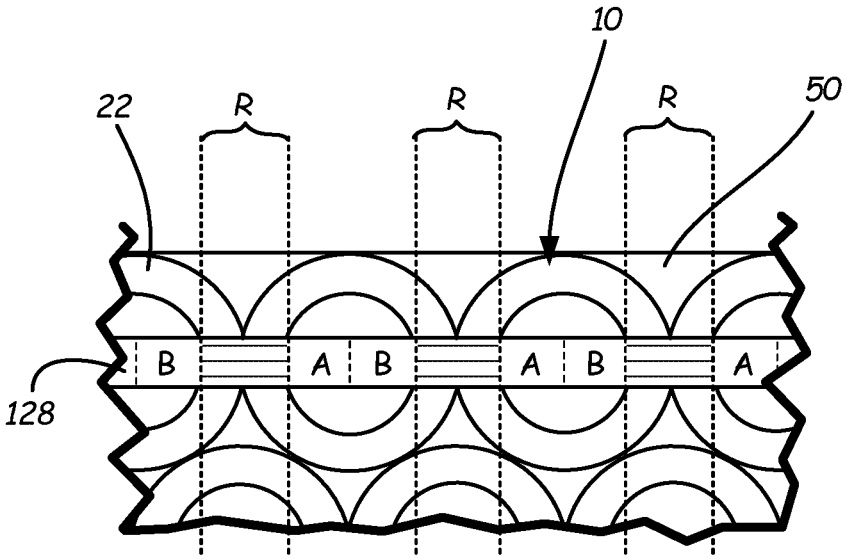
FIG. 17 is a top view of another embodiment of a portion of the composite elastomer web including zones of release agent R.

For example, FIG. 16 is a top view of a portion of the composite elastomer web 50 including zones of release agent R. FIG. 17 is a top view of another embodiment of a portion of the composite elastomer web including zones of release agent R. In the illustrated embodiments, zones R are positioned so that tag strip 128 does not bond to elastic web 50 on a portion of expandable loop of elastic substrate 16 overlaid by tag 28. Accordingly, expandable loop 22 is able to stretch uniformly about its inner and outer perimeters 46, 48. Other figurations of zones of release agent R can also be used. While zones of release agent R are illustrated with a striped pattern to show the locations of R, it is to be understood that the zones R may include a uniform coating of release agent.

In zones R, front surface 30 of web 50 in one embodiment, or back surface 60 of tag strip 128 in another embodiment, is coated with one or more release agents (e.g., a silicone release coating). In another embodiment, the release agent is a separate layer of material disposed between the tag strip 128 and the molten elastomer web 50. This separate layer is then later removed from between the tag 128 and the elastomer web 50, or remains bonded to one of the materials but not the other. Thus, the release agent R may be a coating material or may be a separate layer or sheet of material. Non-limiting examples of suitable release agents include the following: (1) release coating cured by ultraviolet light atop white ink on the tag material substrate (the ink is Flint Ink RVW 30182, available from Flint Group, Ann Arbor, Mich.); (2) silicone-coated polyethylene terephthalate (PET) release film, such as Technicote 2 mil L-15 (a loose release liner film silicone-coated on one side); and (3) silicone-coated PET release with an adhesive backing adhered to the tag material strip 128.

Heat welding achieved by applying heat and pressure on overlapping thermoplastic polymeric materials forming the tag 28 and the elastic substrate 16 can be useful to form the bond therebetween. Significant heat at the interface 42 of overlapping thermoplastic polymeric materials can also result in complete fusion between the polymer of the tag 28 and the polymer of the elastic substrate 16. Sonic welding is another way to unify the layers and achieve a cohesive bond at bond zone 20 between compatible parts. Laminating a molten elastomer to a molten (or at least softened) tag material by co-extrusion is another way of forming bond zone 20. This method can be particularly effective where molecules or parts of molecules of the tag polymer and the molten elastomer substrate material at the bond zone 20 interdiffuse with each other. Bonds can also be formed by interposing an intermediate layer at the bond zone 20 (e.g., a hot melt bonding adhesive) to which both the tag material and the elastic substrate material will readily bond because of their compatibility to the intermediate material. Still further, treatment of the surface areas where bonding is to be accomplished can be effective. Even mechanical bonding can be effective, as where the tag material is porous (e.g., paper and the porous polymer product called "Teslin"), and the elastomeric layer is applied in molten condition or at least in a softened condition and pressed into the voids or interstices of the porous tag layer. Any useful bonding technique and structure that joins the tag 28 with the elastic substrate 16 in a manner forming a unifying flat bond zone 20 that can withstand delamination in expected use is suitable.

In an exemplary embodiment, labeling article 10, 110, 210, 310, 410, 510 has a high-impact polystyrene tag 28 and an elastic substrate 16 formed using a styrene-butadiene-styrene (SBS) block co-polymer available from GLS Corporation under the tradename "Kraton D-2104." This copolymer has several beneficial features such as high clarity, good dimensional stability, food contact acceptability, relatively high strength, low viscosity, ease of coloring, and high elongation. To improve its adhesion to a styrenic tag 28, an optional addition of up to 10 percent by weight of polystyrene (based on the weight of the elastomer in the composition) may be blended in the elastomer composition for elastic substrate 16. The composition can easily be colored, as for example by using polystyrene base color concentrates from Clariant (of Minneapolis, Minn.) or by using polyethylene base color concentrates from Ampacet (of Tarrytown, N.Y.) at concentrations of up to about 5 percent or more of the weight of the base styrene-butadiene-styrene block copolymer.

Those skilled in the art will recognize that any suitable process for the manufacture of the flat labeling articles of this disclosure can be employed. Batch processing is useful for extremely limited production runs. Conveyor processing with indexing from station to station for specific operations can be useful, especially for uniquely designed or shaped tags or elastic substrates.

Figure 10:
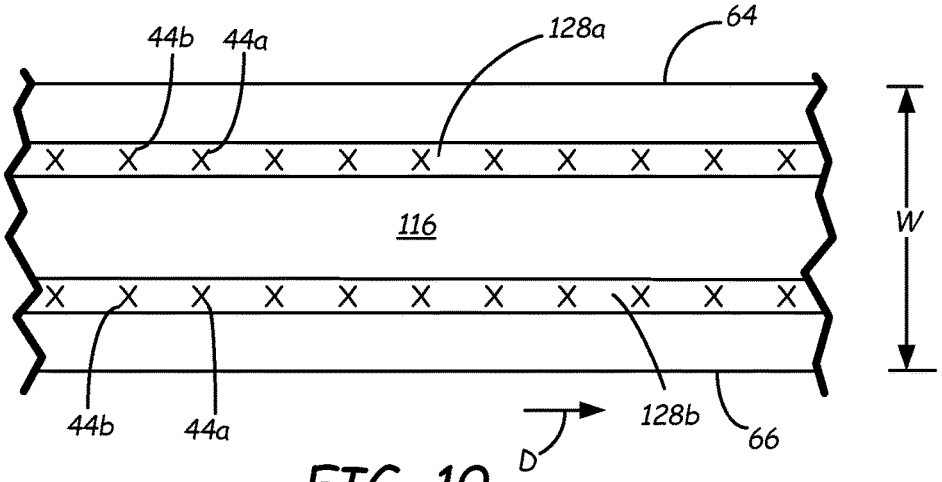
FIG. 10 is a top view of a portion of a composite elastomer web used in an in-line web process to manufacture the linear series of FIG. 1.
Figure 11:
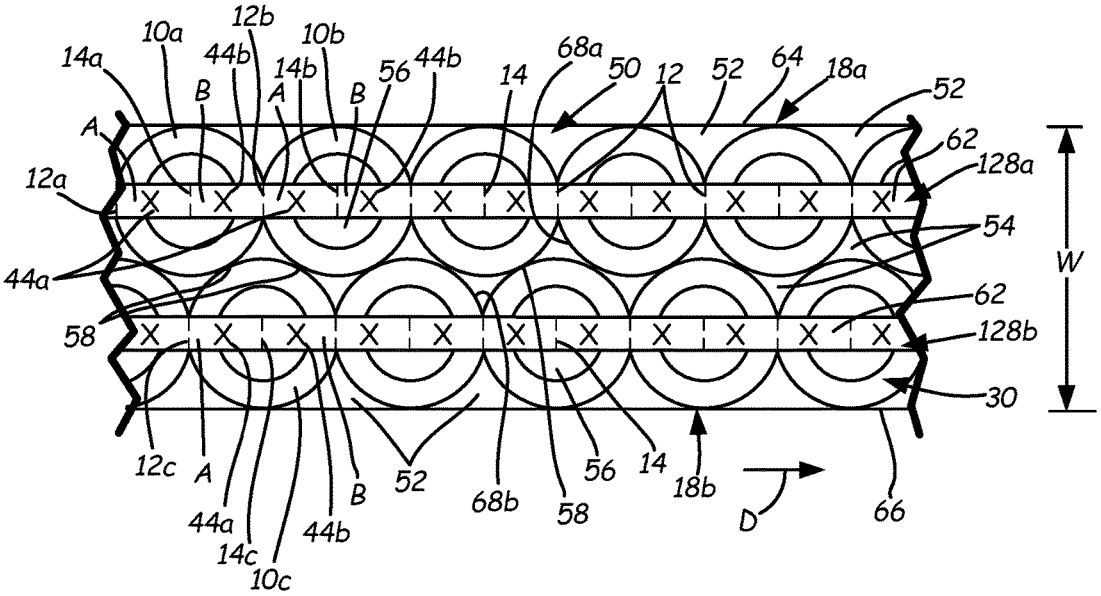
FIG. 11 is a top view of the portion of the composite elastomer web of FIG. 10, further cut to delineate the linear series and flat elastic labeling articles.

As illustrated in FIGS. 10 and 11, an in-line web-based process is especially suitable for manufacturing a web 50 of multiple strips 18*a*, 18*b* of elastic labeling articles 10 from the standpoint of economy. While the discussion of the manufacturing process and web 50 describe and show the configuration of elastic labeling article 10, it is to be understood that the teachings are also applicable to the elastic labeling articles 110, 210, 310, 410, 510, 610 and other forms, as described and contemplated in this disclosure. While FIG. 11 shows an exemplary web 50, of indefinite length in web travel direction D, having two strips 18*a*, 18*b* across a width W thereof, it is contemplated that any number of strips 18 can be arranged across webs of suitable width. As shown in FIG. 10, a web 116 of elastomer material for elastic substrate 16 is moved in web travel direction D. In an exemplary method, strips 128 of material for tag 28 are laid adjacent elastomer web 116 in parallel lines. In an exemplary embodiment, each of strips 128 is pre-formed of high impact polystyrene with a surface treatment such as a well-known corona surface treatment on a back surface 60 to be placed adjacent elastomer web 116. Elastomer web 116 is formed of a thermoplastic elastomer such as styrenic block copolymer.

In the illustrated embodiments, each strip 128 is pre-printed with indicia 44. In another embodiment, indicia 44 may be provided by printing or otherwise on tags 28 at a later stage. Alternatively, linear series 18 may be provided to a customer without indicia, so that the customer may add custom indicia as desired, such as via a printer at a location where article 10, 110, 210, 310, 410, 510, 610 will be applied to product(s) 34, 36. Such custom indicia may include, for example, a date of packing, field information, or other on-demand marking. Suitable printers include thermal transfer printers, inkjet printers, and laser printers, for example.

In an exemplary embodiment, strips 28 are applied to elastomer web 116 when elastomer web 116 is in a partially molten state that may be achieved by extruding molten elastomer material from an extrusion head. The elastomer web 116 with strips 128 thereon is fed between the nip of chill rollers (not shown). The temperature of the chill rollers is adjusted to cool the molten elastomer to an at least partially cured state while simultaneously applying pressure (up to about 500 psi) to form elastomer web 116 at the desired thickness and also to bond strips 128 to elastomer web 116.

Referring to FIGS. 10 and 11, lateral and longitudinal positioning of the composite web 50 (of tag strips 128 and elastomer web 116) is controlled as it is passed in proper registration between die cutting and anvil rollers to cut and score web 50 to provide series 18*a*, 18*b* of labeling articles 10. In one embodiment, linear series 18*a* is separated from linear series 18*b*, and scrap material is removed in regions 52 outside of strips 18, regions 54 between strips 18*a* and 18*b*, and regions 56 for cut-out areas 24. Such scrap material in an exemplary embodiment consists of only or primarily the elastomer material for elastomer web 116 and is therefore easily recycled and reused. The series 18*a*, 18*b* can be further processed for easy storage and use, such as by rolling on a spool, folding, or cutting into shorter lengths and stacking. In embodiments in which tag material strip 128 is essentially maintained in a continuous (albeit perforated) form, the tag material strip 128 facilitates ease of handling of the linear series 18*a*, 18*b*. While the elastic substrate 16 is generally thicker and flimsy, the relatively stiffer but yet flexible tag material strip 128 allows for reliable rolling, folding, stacking and other handling procedures. In another embodiment, strips 18*a* and 18*b* are not fully separated from each other but remain at least partially connected in composite web 50. For example, strips 18*a* and 18*b* may remain connected by not cutting entirely through composite web at points 58, where outer perimeter cut 68*b* of lower linear series 18*b* near outer perimeter cut 68*a* of upper linear series 18*a*. The composite web 50 can be further processed or easy storage and use, such as by rolling on a spool, folding, or cutting into sheets and stacking.

In the illustrated embodiment of FIG. 11, the material of elastomer web 116 is efficiently utilized by staggering the placement of upper linear series 18*a* and lower linear series 18*b* in web direction D. Thus, it can be seen that labeling article 10*c* of lower linear series 18*b* is positioned between (i.e., nested between) labeling articles 10*a* and 10*b* of upper linear series 18*a* in direction D. Moreover, across a line connecting contact points 58 between labeling articles 10*a*, 10*b* and 10*c*, a portion of each labeling article 10*a* and 10*b* extends below the line connecting contact points 58, and a portion of labeling article 10*c* extends above the line connecting contact points 58. Please note the symmetrical configuration of article 10 of FIGS. 1 and 2. Indicia 44*a* are provided on tag section A and indicia 44*b* are provided on tag section B. Perforations 12 are provided between adjacent articles 10, and perforations 14 of a particular article 10 are provided at a mid-point between the perforations 12 at the edges of that band 10. As shown in FIGS. 10 and 11, even though linear series 18*a* and 18*b* are generally offset in direction D, certain elements of the linear series 18*a* and 18*b* are aligned in direction D. For example, where indicia 44*a* and 44*b* are identical repeating indicia, it can be seen that they can be aligned in direction D on upper tag material strip 128*a* and lower tag material strip 128*b*. For example, indicia 44*b* of band 10*a* of upper linear series 18*a* are aligned in direction D with indicia 44*a* of article 10*c* of lower linear series 18*b*. Moreover, perforations 14*c* of article 10*c* of lower linear series 18*b* are aligned in direction D with perforations 12*b* between bands 10*a* and 10*b* of upper linear series 18*a*. While a particular arrangement of features is illustrated and described, it is contemplated that many variations are possible for manufacturing flat elastic labeling articles having the desired configurations and indicia.

While the illustrated composite web 50 shows cuts to form a plurality of flat elastic labeling articles 10, as shown in FIGS. 1 and 2, it is to be understood that the teachings of composite web 50 are also applicable to the configurations of articles 110, 210, 310, 410, 510, 610 and others, with cuts placed in different locations to achieve the desired configurations. Moreover, while FIGS. 10 and 11 illustrate the placement of two parallel tag material strips 128 aligned in the web travel direction D on elastomer web 116 to form two linear series 18*a*, 18*b* of flat elastic labeling articles 10, it is contemplated that many variations are possible. For example, while the illustrated embodiments show that tag sections A and B on a flat elastic labeling article 10 are formed from a single tag material strip 128, it is contemplated that additional tag sections on a single flat elastic labeling article 10 may be created by using additional tag material strips 128, placed as desired.

As shown in FIG. 1, longitudinally adjacent flat elastic labeling articles 10 of linear series 18 are ruptureably connected at perforations 12 so that (whether in strip or roll form) each individual flat elastic labeling article 10 can be ruptureably separated from the remainder of the flat elastic labeling articles 10 of linear series 18. In another embodiment, individual flat elastic labeling articles 10 can be manufactured and provided as separate, unconnected articles 10, such as in stacked form, for example. In still another embodiment, tag sections A and B are completely cut apart, rather than connected by perforations 14. While the ruptureable connections between adjacent labeling articles 10 is described in an exemplary embodiment as including perforations 12, and the ruptureable connection of tag sections A and B in some embodiments is described as including perforations 14, it is contemplated that such ruptureable connections may employ different structures to provide a line or other connection of weakness. Other suitable structures include score or cut line of partial or full depth through at least some portions of tag 28 and/or elastic substrate 16, for example.

Figure 12:
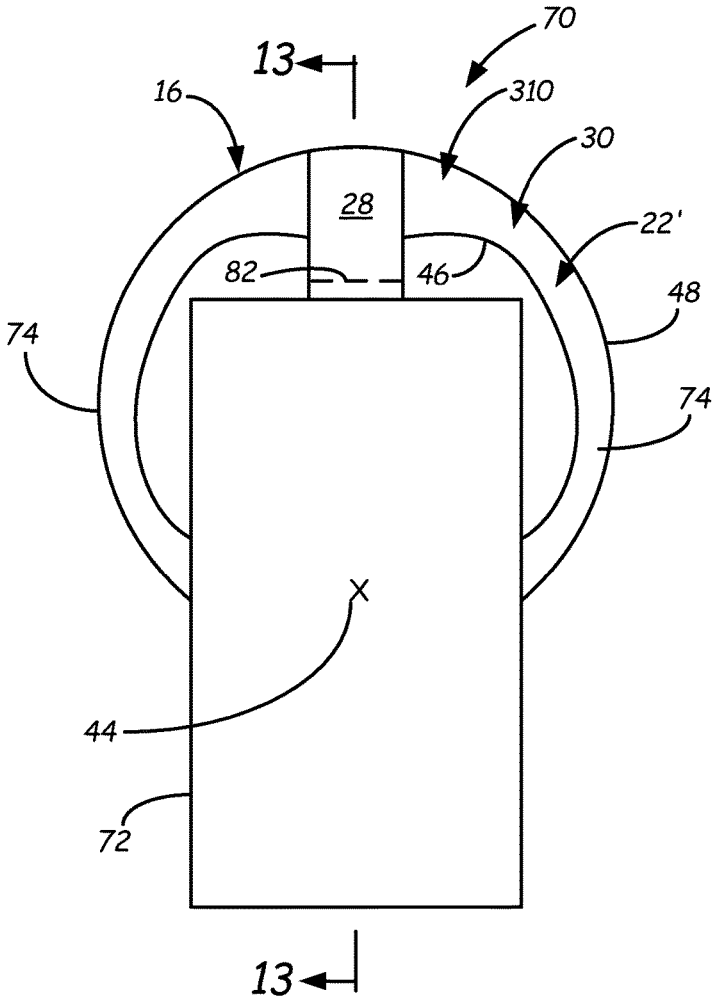
FIG. 12 is a front view of an exemplary assembly of a fourth exemplary flat elastic labeling article and auxiliary tag.

FIG. 12 is a front view of an exemplary embodiment of an assembly 70 of flat elastic labeling article 310 and auxiliary tag 72. In this variation of flat elastic labeling article 310, loop 22' has a non-constant width between inner perimeter 46 and outer perimeter 48. In the illustrated embodiment, loop 22' is wider near tag 28 and narrower at sides 74 remote from tag 28. This configuration allows loop 22' to stretch to a greater length at sides 74 compared to proximate tag 28, for a given stretch force on loop 22'. It is to be understood that analogous assemblies can be formed with auxiliary tag 72 and any of flat elastic labeling articles 10, 110, 210, 310, 410, 510, 610 (and variations of tag 72 and article 10, 110, 210, 310, 410, 510, 610).

Figure 13:
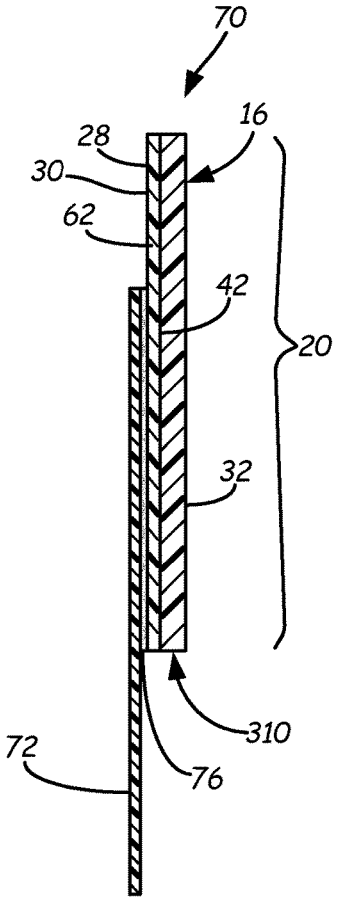
FIG. 13 is a cross-sectional view of the assembly of FIG. 12, taken along line 13-13 of FIG. 12.

FIG. 13 is a cross-sectional view of the assembly of FIG. 12, taken along line 13-13 of FIG. 12. In an exemplary embodiment, auxiliary tag 72 is secured to tag 28 by adhesive layer 76. Adhesive layer 76 is positioned on at least a portion of tag 28 that is overlaid by auxiliary tag 72. Many adhesives are suitable, such as known pressure-sensitive adhesives. Adhesive layer 76 may be applied to tag 28 in an in-line web process for producing composite web 50. Moreover, auxiliary tag 72 may be adhered to tag 28 of flat elastic labeling article 310 via adhesive layer 76 in the in-line web process for producing composite web 50. Alternatively, auxiliary tag 72 may be formed with adhesive layer 76 thereon (optionally protected before assembly to flat elastic labeling article 310 by a release liner). Auxiliary tag 72 may be secured to flat elastic labeling article 310 via adhesive layer 76 manually or by a label application machine, for example. In an exemplary assembly 70, auxiliary tag 72 is secured to flat elastic labeling article 310 at any portion of tag 28. Tag 28 has perforations 14 (not visible) that can be broken to allow a product 34, 36 to be inserted through loop 22, so that auxiliary tag 72 is visible on one side of the inserted product 34, 36. Moreover, as shown in FIG. 12, additional perforations 82 are provided so that auxiliary tag 72 and its underlying tag section are removable from the remainder of flat elastic labeling article 310. Such a configuration is suitable, for example, where auxiliary tag 72 is in the form of a coupon.

In an exemplary embodiment, auxiliary tag 72 is larger than tag 28, thereby providing more surface area for display, yet may otherwise embody the materials, properties, indicia, features and purposes as described for tag 28. Moreover, because auxiliary tag 72 is adhered to tag 28 by adhesive layer 76, materials for forming auxiliary tag 72 are not limited to materials that will bond to elastic substrate 16 absent an adhesive. Accordingly, other suitable materials for auxiliary tag 72 include textiles, metals, and wood, for example. Moreover, auxiliary tag 72 need not be manufactured in an in-line web process; rather, auxiliary tag 72 can be produced in small batches by other methods. For example, auxiliary tag 72 can be custom printed by the consumer, which allows for flexibility in design, content and fabrication (i.e., auxiliary tag 72 can be produced on demand, even on a personal printer). Auxiliary tag 72, while illustrated as rectangular, may be differently shaped, including specialty shapes having outlines corresponding to company logos, whimsical motifs, seasonal and holiday symbols, and other configurations, for example. Moreover, a size of auxiliary tag 72 is not limited by the size of flat elastic labeling article 310.

Because auxiliary tag 72 can be formed of practically any material, the ability to provide indicia 44 of different forms is similarly unlimited. For example, auxiliary tag 72 could be provided with indicia in the form of high end graphics, holograms, human and/or machine readable codes, and information providing radio frequency identification (RFID) or near field communication (NFC) functions, for example. In other embodiments, auxiliary tag 72 may include materials that are receptive to special ways for imparting indicia 44 thereon, such as an auxiliary tag 72 made of wood with burned markings 44 thereon or an auxiliary tag 72 made of a textile with embroidered designs 44 thereon, for example.

It is contemplated that many different articles can be used as the "tag." The auxiliary tag 72 need not be a simple card bearing display information (such as human or machine-readable indicia). Rather, the auxiliary tag 72 may consist of, hold, contain, or be attached to a product sample, coupon, or other promotional item, for example. Such specialty tags may be configured as envelopes, booklets, sachets, folded members, rolled members, looped holders, and sealed packets, for example. Other specialty tags may even have three-dimensional characteristics, such as artificial flowers, bows, figurines and the like. Auxiliary tag 72 may broadly present matter by emitting sound, fragrance, light, and other properties.

While not shown, it is to be understood that adhesive layer 76 may be covered with a release liner applied thereto (such as in the same location as the illustrated auxiliary tag 72) to protect the adhesive layer 76 until its exposure is desired for affixation of a separate auxiliary tag 72. The release liner may be fabricated from a paper and/or polymeric web (e.g., a polyolefin and/or polyethylene terephthalate web) coated with one or more release agents (e.g., a silicone release coating).

FIG. 14 is a front view of a variation of flat elastic labeling article 410. In this variation, interior portion 26' includes more than just a bonded portion of tag 28 and elastic substrate 16. Rather, interior portion 26' also includes unbonded elastic portions $E_1$, $E_2$ and $E_3$. While a particular configuration of interior portion 26' is illustrated, it is contemplated that other variations are possible, limited only by inner perimeter 46. While not shown, it is contemplated that one or more of elastic portions $E_1$, $E_2$ and $E_3$ may include an aperture for hanging, analogous to aperture 38, 38'. In the illustrated embodiment, additional perforations 84 are provided between tag section B' and unbonded elastic portion $E_3$. Accordingly, elastic portion $E_3$ may be removed from the remainder of flat elastic labeling article 410. Such a configuration is suitable, for example, where elastic portion $E_3$ is in the form of a coupon, for example FIG. 15 is a front view of a variation of flat elastic labeling article 510. In this variation, interior portion 26" includes unbonded elastic portions $E_4$, and $E_5$. Each of elastic portions $E_4$, and $E_5$ has aperture 78, around which the elastic substrate forms loop 80. Smaller products may be inserted into one or both of loops 80, so that a primary product 34, 36 may be accompanied by a secondary product, such as a sample or rolled coupon, for example. While a particular configuration of interior portion 26" is illustrated, it is contemplated that other variations are possible, limited only by inner perimeter 46. Moreover, while tag sections A and B are shown with similar configurations of unbonded elastic portions $E_4$, and $E_5$, it is contemplated that the separate tag sections may have different configurations from each other.

FIG. 18 is front view of a seventh exemplary embodiment of a flat elastic labeling article 610. In this embodiment, cut-out areas 24 are provided as two circular holes connected by perforations 14 that separate tag sections A and B and portions of loop 22. In the illustrated embodiment, neither tag section A nor B extends from expandable loop 22.

Exemplary embodiments of the disclosed articles and webs are described as non-limiting examples. A labeling article 10, 110, 210, 310, 410, 510, 610 includes an elastic substrate 16 configured as a first sheet having first major surface 30 and second opposed major surface 32. The labeling article 10, 110, 210, 310, 410, 510, 610 includes a cut at perforations 12 or 14 or at inner circumference 46 disposed through the elastic substrate 16. A tag 28 is configured as a second sheet having back surface 60 and front surface 62 (labeled in FIG. 7), wherein an entirety of the back surface 60 of tag 28 overlies a portion of the first major surface 30 of the elastic substrate 16. The back surface 60 of tag 28 is bonded to the first major surface 30 of the elastic substrate 16. At least a portion of the tag 28 is positioned adjacent the cut at perforations 12 or 14 or at inner circumference 46.

Labeling article 10, 110, 310, 410, 510, 610 includes a first member 16 formed of a sheet-like elastic material that includes a fastening opening 24 therein and an interior portion 26 that projects into the fastening opening 24. Labeling article 10, 110, 310, 410, 510, 610 also includes a second member 28 formed of a sheet-like inelastic material that overlies at least the interior portion 26 of the first member 16, wherein the second member 28 and first member 16 are bonded together along coextensive portions. In each labeling article 10, 110, 210, 310, 410, 510, 610, tag sections A, B are positioned on a portion of expandable loop 22.

At least a portion of tag 28 is positioned adjacent the cut at perforations 12 or 14 or at inner circumference 46. A cut through elastic substrate 16 at inner circumference 46 forms a portion of aperture 24 through elastic substrate 16. Tag 28 includes two sections A, B (or A', B' or A", B") that are separable from each other. As shown in the embodiments of FIGS. 1-2, 4A-4B, and 15 tag sections A, B are substantially equal in size, and tag sections A", B" are substantially equal in size. As shown in FIGS. 3, 5 and 6, an aperture 38, 38' is disposed in tag section B'. In an exemplary embodiment, tag 28 is formed of a substantially inextensible, inelastic material. Indicia 44 are disposed on the front surface 62 of tag 28. In exemplary embodiments, elastic substrate 16 is configured to substantially include a loop 22 with an interior portion 26 passing through a center of the loop 22, wherein tag 28 is positioned on the interior portion 26.

A composite web 50 of a plurality of labeling articles 10 includes an elastic material web 116, a first tag material strip 128*a* and a second tag material strip 128*b*. Elastic material web 116 has a width dimension W between first edge 64 and opposed second edge 66. Elastic material web 116 has first major surface 30 and second opposed major surface 32. Elastic material web 116 has a length dimension in a web movement direction D substantially orthogonal to the width dimension W. First tag material strip 128*a* has a front surface 62 and an opposed back surface 60. The first tag material strip 128*a* overlies a first portion of the first major surface 30 of the elastic material web 116 between the first and second opposed edges 64, 66 and does not extend beyond either of the first or second opposed edges 64, 66. The back surface 60 of the first tag material strip 128*a* is bonded to the first major surface 30 of the elastic material web 116. The second tag material strip 128*b* has a front surface 62 and an opposed back surface 60. The second tag material strip 128*b* overlies a second portion of the first major surface 30 of the elastic material web 116 between the first and second opposed edges 64, 66 and does not extend beyond either of the first or second opposed edges 64, 66. The back surface 60 of the second tag material strip 128*b* is bonded to the first major surface 30 of the elastic material web 116.

The composite web 50 further includes scalloped-shaped outer perimeter cuts 68*a*, 68*b* through the elastic material web 116 that at least partially separate a first linear series 18*a* of articles 10 from a second linear series 18*b* of articles 10. The first linear series 18*a* includes the first tag material strip 128*a*, and the second linear series 18*b* includes the second tag material strip 128*b*. The composite web 50 further includes a first aperture 24 (formed by removing scrap region 56) through the elastic material web 116, the first aperture 24 located on one of the plurality of labeling articles 10.

The composite web 50 further includes a cut at perforations 12*a* through the first tag material strip 128*a* and an underlying portion of the elastic material web 116 that at least partially separates adjacent labeling articles 10 of the first linear series 18*a*. The composite web 50 further includes a cut at perforations 14*a* through the first tag material strip 128*a* and an underlying portion of the elastic material web 116 that at least partially separates first section A and second B of the tag material strip 28 of an individual labeling article 10*a* of the first linear series 18*a*. The composite web 50 further includes a cut 12*c* through the second tag material strip 128*b* and an underlying portion of the elastic material web 116 that at least partially separates adjacent labeling articles 10 of the second linear series 18*b*, wherein the cut 12*c* is offset along the length dimension D from the cut 12*a*. Cut 14*a* is aligned along the length dimension D with the cut 12*c*.

In composite web 50, a first set of the plurality of labeling articles 10 in top series 18*a* are offset along the length dimension D from a second set of the plurality of labeling articles 10 in bottom series 18*b*. In composite web 50, each of the first tag material strip 128*a* and the second tag material strip 128*b* includes a repeating pattern of printed indicia 44. As shown in FIG. 10, the printed indicia 44 of the first tag material strip 128*a* is aligned along the length dimension D with the printed indicia 44 of the second tag material strip 128*b*.

Those skilled in the art will readily recognize that the teachings of this disclosure may be embodied in specific forms other than those illustrated without departing from the essential described characteristics. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A labeling article including:

an elastic substrate configured as a first sheet having first and second opposed major surfaces and including a cut disposed through the elastic substrate; and a tag configured as a second sheet having third and fourth opposed major surfaces, wherein:

an entirety of the third major surface of the tag overlies a portion of the first major surface of the elastic substrate;

the third major surface of the tag is bonded to the first major surface of the elastic substrate;

at least a portion of the tag is positioned adjacent the cut; and the tag includes two sections that are separable from each other.

2. The labeling article of claim 1 wherein the two sections are substantially equal in size.

3. The labeling article of claim 1 wherein the cut forms a perforation.

4. The labeling article of claim 1 wherein the cut forms a portion of an aperture through the elastic substrate.

5. The labeling article of claim 1 wherein the tag is formed of a substantially inextensible material.

6. A labeling article including:

an elastic substrate configured as a first sheet having first and second opposed major surfaces and including a cut disposed though the elastic substrate, wherein the elastic substrate is configured to substantially include a loop with an interior portion passing through a center of the loop; and a tag configured as a second sheet having third and fourth opposed major surfaces, wherein:

an entirety of the third major surface of the tag overlies a portion of the first major surface of the elastic substrate;

the third major surface of the tag is bonded to the first major surface of the elastic substrate;

at least a portion of the tag is positioned adjacent the cut; and the tag is positioned on the interior portion.

7. The labeling article of claim 6 wherein the cut forms a perforation.

8. The labeling article of claim 6 wherein the cut forms a portion of an aperture through the elastic substrate.

9. The labeling article of claim 6 wherein the tag is formed of a substantially inextensible material.

10. A labeling article including:

a first member formed of a sheet-like elastic material that includes a fastening opening therein and an interior portion that projects into the fastening opening; and a second member formed of a sheet-like inelastic material that overlies at least the interior portion of the first member, wherein the second member and first member are bonded together along coextensive portions.

11. A composite web of a plurality of labeling articles including:

an elastic material web having a width dimension between first and second opposed edges, having first and second opposed major surfaces, and having a length dimension in a direction substantially orthogonal to the width dimension;

a first tag material strip having third and fourth opposed major surfaces, wherein:

the first tag material strip overlies a first portion of the first major surface of the elastic material web between the first and second opposed edges and does not extend beyond either of the first or second opposed edges; and the third major surface of the first tag material strip is bonded to the first major surface of the elastic material web; and a second tag material strip having fifth and sixth opposed major surfaces, wherein:

the second tag material strip overlies a second portion of the first major surface of the elastic material web between the first and second opposed edges and does not extend beyond either of the first or second opposed edges; and the fifth major surface of the second tag material strip is bonded to the first major surface of the elastic material web.

12. The composite web of claim 11 further including a first cut through the elastic material web that at least partially separates a first linear series of a first set of the plurality of labeling articles including the first tag material strip and a second linear series of a second set of the plurality of labeling articles including the second tag material strip.

13. The composite web of claim 12 further including a first aperture through the elastic material web, the first aperture located on one of the plurality of labeling articles.

14. The composite web of claim 12 further including a second cut through the first tag material strip and an underlying portion of the elastic material web that at least partially separates adjacent labeling articles of the first linear series.

15. The composite web of claim 14 further including a third cut through the first tag material strip and an underlying portion of the elastic material web that at least partially separates first and second sections of the tag material strip of an individual labeling article of the first liner series.

16. The composite web of claim 14 further including a third cut through the second tag material strip and an underlying portion of the elastic material web that at least partially separates adjacent labeling articles of the second linear series, wherein the third cut is offset along the length dimension from the second cut.

17. The composite web of claim 16 further including a fourth cut through the first tag material strip and an underlying portion of the elastic material web that at least partially separates first and second sections of the tag material strip of an individual labeling article of the first linear series, wherein the fourth cut is aligned along the length dimension with the third cut.

18. The composite web of claim 12 wherein the first set of the plurality of labeling articles are offset along the length dimension from the second set of the plurality of labeling articles.

19. The composite web of claim 11 wherein each of the first tag material strip and the second tag material strip includes a repeating pattern of printed indicia.

20. The composite web of claim 19 wherein the printed indicia of the first tag material strip are aligned along the length dimension with the printed indicia of the second tag material strip.

* * * * *